US006092511A

United States Patent [19]

Middlebrook

[11] Patent Number: 6,092,511

[45] Date of Patent: Jul. 25, 2000

[54] DRIVE EXTENDER FOR SUPERCHARGERS

[75] Inventor: James K. Middlebrook, Moorpark, Calif.

[73] Assignee: Vortech Engineering, Inc., Moorpark, Calif.

[21] Appl. No.: 09/183,784

[22] Filed: Oct. 30, 1998

[51] Int. Cl.[7] ..... F02B 33/00

[52] U.S. Cl. ..... 123/559.1

[58] Field of Search ..... 123/559.1, 559.3

[56] References Cited

U.S. PATENT DOCUMENTS

| | | | |
|---|---|---|---|
| 1,479,993 | 1/1924 | Kirkham . | |
| 2,839,038 | 6/1958 | Middlebrooks, Jr. . | |
| 2,894,498 | 7/1959 | Chaplin et al. . | |
| 2,949,902 | 8/1960 | Calovolo . | |
| 4,519,373 | 5/1985 | Hardy et al. | 123/559.1 |
| 4,554,787 | 11/1985 | Wilhelm et al. | 60/605 |
| 4,844,044 | 7/1989 | McGovern | 123/559.1 |
| 5,423,304 | 6/1995 | Lawrence et al. | 123/559.1 |

*Primary Examiner*—Noah P. Kamen
*Attorney, Agent, or Firm*—Christie Parker & Hale, LLP

[57] ABSTRACT

A drive extender for a supercharger. The drive extender has a tubular drive shaft with a proximal end and a distal end and a separate coupler portion affixed to the proximal end. The coupler is for detachable engagement with a drive gear shaft of the supercharger. A pulley interface portion is press fitted or otherwise attached to the distal end of the drive shaft. A supercharger engaging flange is provided for engagement with a flat face of the supercharger. A tubular sleeve with a proximal end and a distal end is provided, with the proximal end affixed to a supercharger engaging flange and extending perpendicular thereto. A bearing enclosure portion containing bearings and having a bearing enclosure flange portion is provided. The distal end of the tubular sleeve is affixed to the bearing enclosure flange portion, and the pulley interface portion is rotatably held in alignment by the bearing, and the pulley interface portion, the drive shaft, and coupler are retained in axial alignment with the drive gear shaft of the supercharger.

14 Claims, 2 Drawing Sheets

3
3
10
12
14
16
18
20
22
24
26
28
30
32
34
36
38
40
42
44
46
48
50
52
54
56
58
60
62

DRIVE EXTENDER FOR SUPERCHARGERS

FIELD OF THE INVENTION

Drive systems, and more particularly a drive extender for superchargers, to allow superchargers to be positioned a substantial distance away from the engine belts.

BACKGROUND OF THE INVENTION

Supercharging of internal combustion engines is a well-established method of obtaining greater power output from engines of a given size. Automotive superchargers are most often powered by pulleys and belts and are necessarily placed close to the belts. However, due to space considerations, it is sometimes difficult to fit superchargers into the tight confines under the hood of many modern automobiles. Indeed, the alternator, water pump, air conditioning compressor, power steering pump, power brake pump, and other accessories are often crowded in the vicinity of the belts, leaving little space for a supercharger. As a result, it has heretofore been inconvenient to equip some automobiles with superchargers, particularly in after-market applications and without substantial redesign of the engine.

U.S. Pat. No. 2,839,038 to Middlebrooks, Jr. discloses a drive system for supercharger for an internal combustion engine that is positioned directly above a carburetor. In one embodiment, in lieu of an electric motor to drive the supercharger, an elongate drive shaft with a bevel gear is positioned in a cylindrical tubular case with fins. The driven end has a pulley and is unsupported.

U.S. Pat. No. 1,479,993 to Kirkham discloses a supercharger for an aircraft with an extending drive directly geared to a power source.

U.S. Pat. No. 5,060,622 to Suzuki discloses an internal combustion engine for a supercharger with a pulley on one side of the engine near the transmission, and an exposed drive shaft with pulleys on both ends. The drive shaft is bolted to the engine with pillow blocks, with bearings rotatably holding the drive shaft. The drive shaft is aligned with one pulley in line with the drive belts of the engine to get power from the engine. The other end of the drive shaft is aligned so that its pulley is in line with the pulley on the supercharger. The rotating drive shaft is exposed, and is only indirectly connected to the supercharger via a belt, and requires not only mounting brackets for the supercharger, but mounting points and brackets for the drive shaft that should be parallel to the engine's crankshaft as well.

There accordingly is a need for a drive extender for superchargers that cart be manufactured precisely yet at an economical cost, that is compact, durable, and readily installed on a variety of different automobiles.

BRIEF DESCRIPTION OF THE INVENTION

The invention provides a drive system for a supercharger that permits a supercharger to be positioned a substantial distance away from the pulleys and associated belts connected to the crank shaft of an automobile engine (e.g. on the other side of the engine).

The invention further provides a drive system that is preferably self-aligning with the drive shaft input of a supercharger so that smooth and relatively vibration-free power can be delivered to the supercharger.

The invention yet further provides a drive system that can be cost-effectively manufactured to suit a variety of supercharger applications.

The invention additionally provides a drive system that has its drive shaft enclosed for greater safety and durability.

The invention also provides a drive system that is well-adapted for use with electromagnetic and other clutching mechanisms to the supercharger.

BRIEF DESCRIPTION OF THE DRAWINGS

This invention may be more clearly understood from the following detailed description and by reference to the drawing in which.

DETAILED DESCRIPTION OF THE INVENTION

Figures 1, 2:
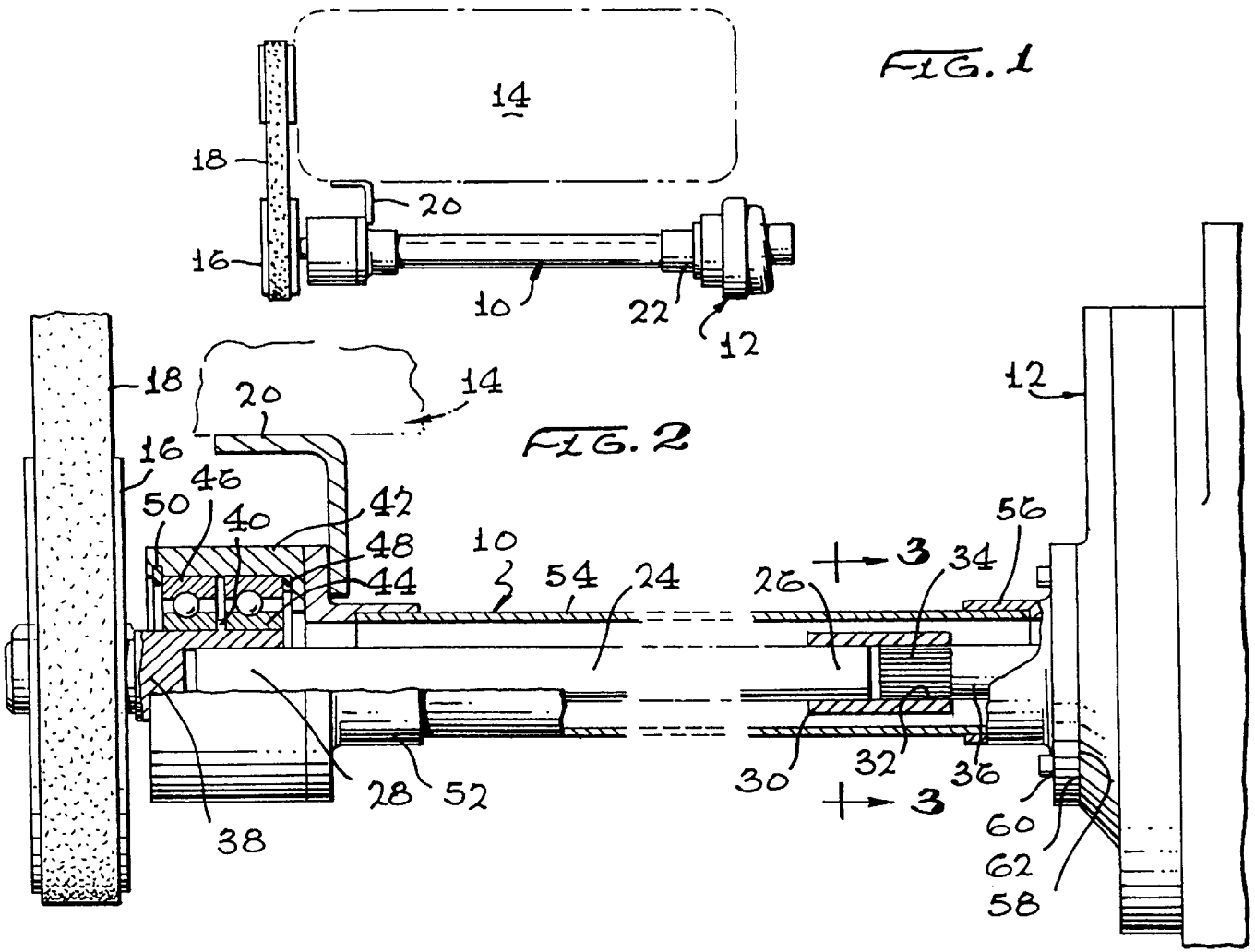
FIG. 1 is a small overall view showing the drive extender of the invention connected to the supercharger and to the engine of a vehicle.
FIG. 2 is a cross-sectional view of the drive extender connected to the supercharger.

Referring first to FIG. 1 is a small overall view showing the drive extender 10 of the invention connected to a supercharger 12 and to the engine 14 of a vehicle. A, pulley 16 is positioned on the end of drive extender 10 not connected to the supercharger 12. A belt 18 from the engine loops around pulley 16. Drive extender 10 is preferably attached to the engine 14 via a bracket means 20. A proximal end 22 of drive extender 10 is attached to supercharger 12.

Figure 3:
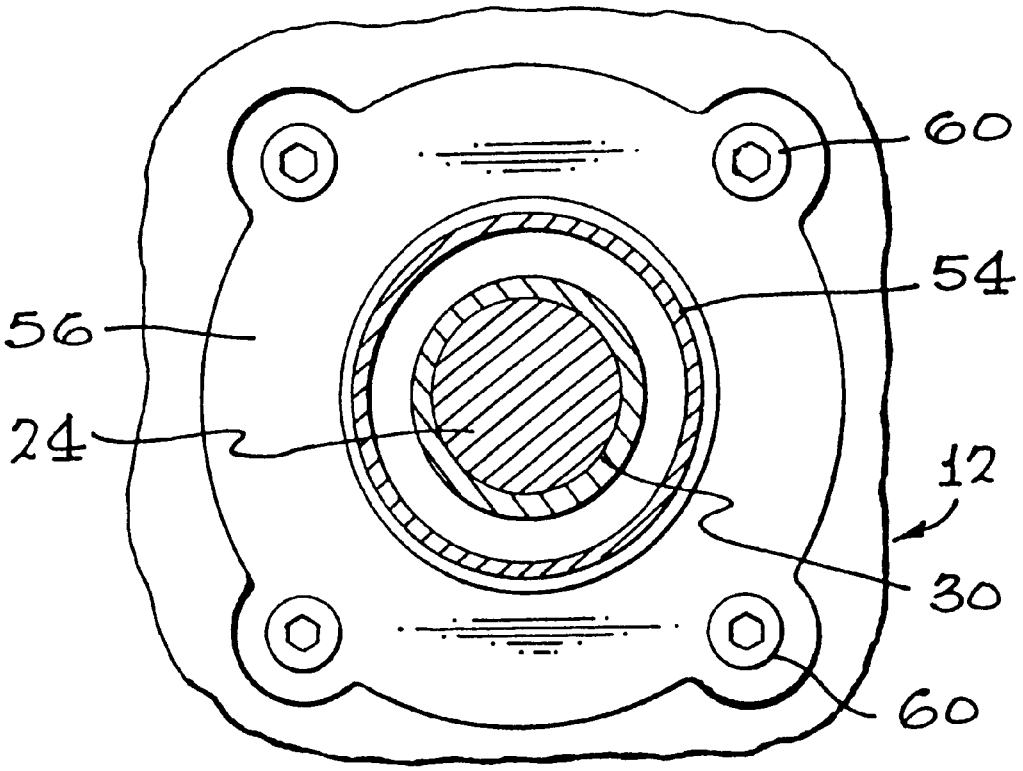
FIG. 3 is a vertical cross-sectional view of the drive extender through view lines 3—3 of FIG. 2.

FIG. 2 is a cross-section view of the drive extender 10 connected to the supercharger 12. Drive extender 10 has a drive shaft 24 with a proximal end 26 and a distal end 28. A coupler 30 is press fitted onto proximal end 26. Coupler 30 has detachable attachment means formed thereon, such as internal splines 32. These splines 32 engage with complementary splines 34 formed on a drive gear shaft 36 extending from supercharger 12. Other known means of detachable attachment means can be used. A pulley interface portion 38 is press fitted onto distal end 28 of drive shaft 24. Pulley interface portion 38 has a flange 40 extending therefrom. A bearing enclosure portion 42 is located at the distal end of the drive extender 10. It encloses bearing races (or bearings), 44 and 46, which ride on pulley interface portion 38. A spring 48 and retaining ring 50 keep bearing races 44 and 46 in bearing enclosure portion 42. A bearing enclosure flange portion 52 extends from bearing enclosure portion 42. An elongate tubular sleeve 54 with proximal and distal ends 54*a* and 54*b*, respectively, is provided. It is sized to be slightly press fitted into bearing enclosure flange portion 52 at its distal end and rosette welded thereto. A supercharger engaging flange 56 is provided. The supercharger engaging flange 56 is likewise adapted to be slightly press fitted to elongate tubular sleeve 54 at its proximal end and rosette welded thereto. Supercharger engaging flange 56 has a flat face 58 and a bolt hole pattern 60 (as shown in FIG. 3) that matches a Rat interfacing flange 62 of supercharger 12 that is perpendicular to the drive gear shaft 36. The arrangement of the flat interfacing flange 62 of supercharger, the flat face 58 supercharger engaging flange 56, the tubular sleeve 54, and bearing enclosure flange portion 52 provide axial alignment of the drive shaft 24 relative to the drive gear shaft 36 extending from supercharger 12. In addition to helping stabilize this axial alignment, tubular sleeve 54 encloses the rapidly rotating drive shaft 24 for enhanced safety and durability. Bracket means 20 can be attached directly to bearing housing 40, or to the tubular sleeve 54, and attached to the engine to help stabilize the distal end of drive extender 10.

In lieu of the separate coupler 30 and drive shaft 24 that are press fitted together, a unitary drive shaft and coupler (not shown) can be used. However, the inventor has found that use of a separate coupler 30 press fitted onto drive shaft 24 can be manufactured at a lower cost since perfectly symmetrical stock can be readily obtained, and cut to size as needed. Indeed, by cutting the tubular sleeve 30 and drive shaft 24 to a desired length, the drive extender can be made to suit any number of supercharger applications in a variety of vehicles.

FIG. 3 shows a vertical cross-section view of the drive extender 10 through view lines 3—3 of FIG. 2 attached to supercharger 12. The drive shaft 24, coupler 30, tubular sleeve 54 fitted to supercharger engaging flange 56, the bolt hole pattern 60 in the supercharger engaging flange 56, and the flat interfacing flange 62 on the supercharger 12 are shown.

The above-described embodiments of the present invention are merely descriptive of its principles and are not to be considered limiting. The scope of the present invention instead shall be determined from the scope of the following claims including their equivalents.

I claim:

1. A drive extender for a supercharger having a drive gear shaft, the drive extender comprising:

a drive shaft with a proximal end and a distal end, the drive shaft comprising a tubular portion and a coupler portion on the proximal end thereof, the coupler having splines formed therein to detachably engage with the drive gear shaft of the supercharger;

a supercharger engaging flange adapted to engage with the supercharger;

a tubular sleeve with a proximal end and a distal end, the proximal end affixed to the supercharger engaging flange and extending perpendicular thereto; and a bearing enclosure portion containing bearings and having a bearing enclosure flange portion, the distal end of the tubular sleeve being affixed to the bearing enclosure flange portion, wherein the drive shaft is rotatably retained in axial alignment with the drive gear shaft of the supercharger, a tubular sleeve with a proximal end and a distal end, the proximal end affixed to the supercharger engaging flange and extending perpendicular thereto; and a bearing enclosure portion containing bearings and having a bearing enclosure flange portion, the distal end of the tubular sleeve being affixed to the bearing enclosure flange portion, wherein the drive shaft is rotatably retained in axial alignment with the drive gear shaft of the supercharger.

2. The drive extender for a supercharger of claim 1, further comprising a pulley interface portion adapted to be attached to the distal end of the drive shaft, the bearings supporting the pulley interface portion.

3. The drive extender for a supercharger of claim 1, further comprising a bracket for attaching the distal end of the drive extender to the engine.

4. The drive extender for a supercharger of claim 1, wherein the coupler is unitary with the proximal end of the drive shaft.

5. The drive extender for a supercharger of claim 1, wherein supercharger has a interfacing flange that is flat and is perpendicular to the drive gear shaft, and the supercharger engaging flange is flat and adapted to be attached to the supercharger interfacing flange and hold the drive extender in axial alignment with the drive gear shaft.

6. A drive extender for a supercharger having a drive gear shaft and a interfacing flange that is flat and is perpendicular to the drive gear shaft, the drive extender comprising:

a drive shaft with a proximal end and a distal end, the proximal end adapted to detachably engage with the drive gear shaft of the supercharger;

a supercharger engaging flange that is flat and adapted to engage with the interfacing flange of the supercharger;

a tubular sleeve with a proximal end and a distal end, the proximal end affixed to the supercharger engaging flange and extending perpendicular thereto; and a bearing enclosure portion containing bearings and having a bearing enclosure flange portion, the distal end of the tubular sleeve being affixed to the bearing enclosure flange portion, wherein the drive shaft is rotatably retained in axial alignment with the drive gear shaft of the supercharger.

7. The drive extender for a supercharger of claim 6, further comprising a bracket for attaching the distal end of the drive extender to the engine.

8. A drive extender for a supercharger, the supercharger having a drive gear shaft and a flat interfacing flange perpendicular to the drive gear shaft, the drive extender comprising:

a drive shaft comprising a tubular portion with a proximal end and a distal end and a separate coupler portion affixed to the proximal end thereof; the coupler being adapted to detachably engage with the drive gear shaft of the supercharger;

a pulley interface portion adapted to be press fitted to the distal end of the drive shaft;

a supercharger engaging flange having a flat face and adapted to engage with the flat interfacing flange of the supercharger;

a tubular sleeve with a proximal end and a distal end, the proximal end affixed to the supercharger engaging flange and extending perpendicular thereto; and a bearing enclosure portion containing bearings and having a bearing enclosure flange portion, the distal end of the tubular sleeve being affixed to the bearing enclosure flange portion, wherein the pulley interface portion is rotatably held in alignment by the bearings, and wherein the pulley interface portion, the drive shaft, and coupler are retained in axial alignment with the drive gear shaft of the supercharger.

9. The drive extender for a supercharger of claim 8, further comprising a pulley attached to the pulley interface portion.

10. The drive extender for a supercharger of claim 8, further comprising a bracket for attaching the distal end of the drive extender to the engine.

11. A drive extender for a supercharger having a drive gear shaft, the drive extender comprising:

a drive shaft with a proximal end and a distal end, the proximal end adapted to detachably engage with the drive gear shaft of the supercharger; a bracket for attaching the distal end of the drive extender to the engine;

a supercharger engaging flange adapted to engage with the supercharger;

a tubular sleeve with a proximal end and a distal end, the proximal end affixed to the supercharger engaging flange and extending perpendicular thereto; and a bearing enclosure portion containing bearings and having a bearing enclosure flange portion, the distal end of the tubular sleeve being affixed to the bearing enclosure flange portion, wherein the drive shaft is rotatably retained in axial alignment with the drive gear shaft of the supercharger.

12. The drive extender for a supercharger of claim 11, wherein splines are formed in the coupler portion for detachable attachment to the drive gear shaft of the supercharger.

13. The drive extender for a supercharger of claim 11, wherein the drive shaft comprises a tubular portion and a separate coupler portion affixed to the proximal end thereof.

14. The drive extender for a supercharger of claim 13, further comprising a pulley attached to the pulley interface portion.

* * * * *